United States Patent [19]

Nishiguchi et al.

[11] 4,230,784

[45] Oct. 28, 1980

[54] ELECTROSTATIC IMAGE FORMING PROCESS AND PARTICLES COMPRISING REACTIVE SUBLIMABLE DYE, SUBLIMING DEVELOPER AND CONDUCTIVE SUBSTANCE

[75] Inventors: Hisanori Nishiguchi, Neyagawa; Eisuke Ishida, Nara; Yuji Takashima, Osaka, all of Japan

[73] Assignee: Matsushita Electric Industrial Co., Ltd., Japan

[21] Appl. No.: 942,500

[22] Filed: Sep. 13, 1978

Related U.S. Application Data

[63] Continuation of Ser. No. 819,506, Feb. 26, 1977, abandoned.

[30] Foreign Application Priority Data

Jul. 27, 1976 [JP] Japan ..... 51-89927

[51] Int. Cl.[2] ..... G03G 9/08

[52] U.S. Cl. ..... 430/42; 430/120; 430/106; 430/109; 430/66; 430/124

[58] Field of Search ..... 252/62.1 P, 62.1 L; 430/109, 106, 42, 120, 66, 124

[56] References Cited

U.S. PATENT DOCUMENTS

| | | | |
|---|---|---|---|
| 2,940,847 | 6/1960 | Kaprelian | 96/1 |
| 3,080,251 | 3/1963 | Claus | 252/62.1 X |
| 3,337,288 | 8/1967 | Horiguchi et al. | 8/4 |
| 3,669,922 | 6/1972 | Bartsch | 260/41 |
| 3,938,922 | 2/1976 | Jadwin | 252/62.1 P |
| 4,054,712 | 10/1977 | Nagashima et al. | 252/62.1 P X |
| 4,145,300 | 3/1979 | Hendriks | 252/67.1 |

*Primary Examiner*—John D. Welsh

*Attorney, Agent, or Firm*—Wenderoth, Lind & Ponack

[57] ABSTRACT

Image forming particles for use in electrostatic image formation, which particles have a light transmitting property, said particles comprising an electrically conductive material and subliming substance. The electrically conductive particles exhibit superior translucency which enables a charge preliminarily imparted to a photoconductive support member to be readily erased upon exposure to light image from an original, with consequent reduction of electrostatic attraction between the particles and the support member to minimum for presenting clear and definite images without fogging. Furthermore, the particles are electrically independent due to absence of electrostatic attraction therebetween and because of their electrical conductivity adhere to the support member by electrostatic induction of the charge imparted to the latter without adhesion between the particles, thus being uniformly arranged on the support member in one single layer and as close to each other as possible, thus offering resultant images of superior quality.

19 Claims, 13 Drawing Figures

Figure 1:
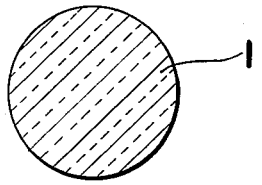

ELECTROSTATIC IMAGE FORMING PROCESS AND PARTICLES COMPRISING REACTIVE SUBLIMABLE DYE, SUBLIMING DEVELOPER AND CONDUCTIVE SUBSTANCE

This is a continuation, of application Ser. No. 819,506, filed Feb. 26, 1977, now abandoned.

The present invention relates to electrostatic image formation and more particularly, to image forming particles particularly useful for electrostatic image formation employing fine particles.

Conventionally, there have been proposed several image forming methods employing the fine particles represented, for example, by electro-print making method, Sugarman method, etc., in which photoconductive particles are employed as image forming material. In any of these known methods, it is so arranged that the image is formed by the particles through selective distinguishability between charged particles and uncharged particles by electrical or mechanical means, depending on the charged condition of the photoconductive particles distributed on an electrically conductive support member.

More specifically, the conventional image forming methods as described above utilize the photocondutive function of the image forming particles themselves for conversion of light image into particle image. In the electroprint making method, since a material mainly composed of zinc oxide is employed in photoconductive particles, with consequent poor light transmitting property, it is difficult, in actual practice, to arrange the photoconductive particles on the electrically conductive support member in one layer without overlapping and yet as close to each other as possible, with ohmic contact of the same photoconductive particles with the electrically conductive support member.

Accordingly, residual charge remaining in the particles after exposure thereof to light has undesirably resuled in formed images significantly affected by fogging. On the other hand, in the Sugerman method, due to insufficient contact between the photoconductive pigment particles and injecting electrode, sufficient number of electrons can not be injected within the dielectric breakdown voltage of air even upon sensitization, and thus the formed images available tend to have poor contrast. Furthermore, technical difficulty for making uniform the electrostatic characteristics of the individual particles further deteriorates the quality of the formed image in terms of contrast. Moreover, when a color image is to be formed by the photocondutive pigment particles as described above, sufficient superposition of colors has not been available due to their poor translucency. Accordingly, the resultant images obtained tend to be poor not only in the reproduction of color, but also in definition.

Accordingly, an essential object of the present invention is to provide image forming particles for use in electrostatic image formation which are capable of forming definite images with little fogging.

Another important object of the present invention is to provide image forming particles of the above described type which are best suited to a process of obtaining color image having superior color reproduction through only one exposure stage and only one developing stage.

A further object of the present invention is to provide image forming particles of the above described type which have light transmitting and electrically conductive properties.

A still further object of the present invention is to provide image forming particles of the above described type which are stable in performance and simple in structure, and can be readily manufactured at low cost.

In accomplishing these and other objects, according to the present invention, each of the image forming particles of light transmitting property for use in electrostatic image formation includes a particle defining material or structure containing therein electrically conductive material and subliming substance. The particles superior in translucency enable, owing to their electrical conductivity, the charge preliminarily imparted to a photoconductive support member to be readily erased upon exposure thereof to image-wise light from an original, with consequent reduction of electrostatic attraction between the particles and the support member to minimum, to present clear and definite formed images with little fogging. Furthermore, since the particles are electrically independent due to absence of electrostatic attraction therebetween and because of their electrical conductivitys they adhere to the support member of electrostatic induction of the charge imparted to the latter without adhesion between the particles. Thus, it is possible to uniformly arrange the particles on the support member approximately in one single layer and as close to each other as possible. Thereby, the resultant images of still higher quality are obtained with substantial elimination of disadvantages inherent in the conventional image forming particles.

Figure 4:
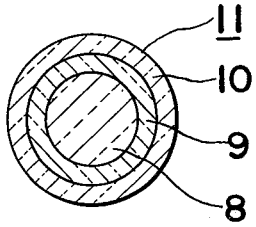
Figure 9:
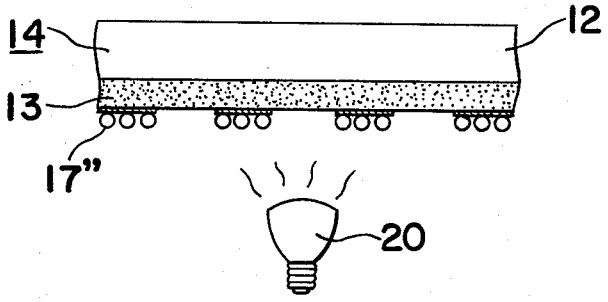
Figure 10:
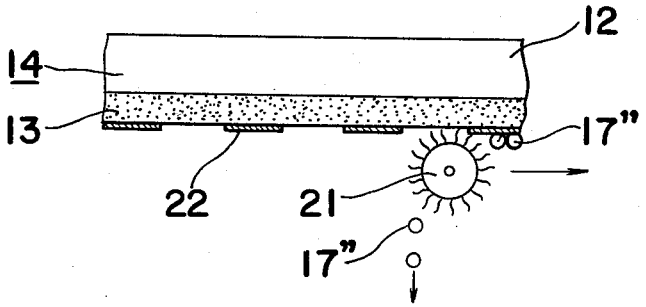
Figure 11:
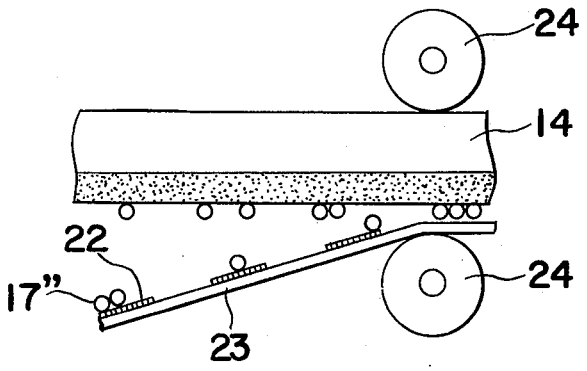
Figure 12:
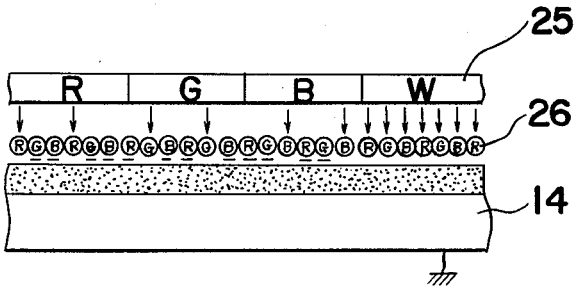
Figure 13:
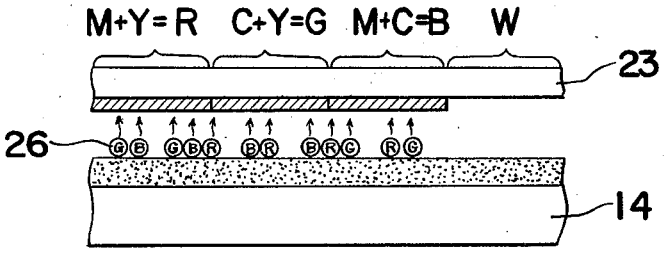

These and other objects and features of the present invention will become apparent from the following description taken in conjunction with the preferred embodiment thereof with reference to the attached drawings in which, FIGS. 1 and 4 are schematic diagrams each showing, on an enlarged scale, construction of an image forming particle according to the present invention, FIGS. 5 to 10 are schematic diagrams sequentially showing a method of image formation with the use of image forming particles according to the present invention, FIG. 11 is a similar diagram to FIGS. 5 to 10, but particularly shows a modification thereof, and FIGS. 12 and 13 are similar diagrams to FIGS. 5 to 10, but particularly show another modification thereof for color image formation.

Before the description of the present invention proceeds, it is to be noted that like parts are designated by like reference numerals throughout several view of the accompanying drawings.

It should also be noted that image formation method to which image forming particles of the present invention may be applied is described in detail in U.S. patent application Ser. No. 741,022 of Takashima et al. entitled "Image formation method and apparatus therefor", and reference may be made thereto for details thereof.

In the fundamental construction and principle of a method for formation of images employing image forming particles according to the present invention, when light image is projected onto the image forming particles having light transmitting properties and evenly distributed over a surface of a photoconductive support member preliminarily charged, the light reaches the photoconductive support member after havine passed through the image forming particles to erase the charge preliminary imparted to the photoconductive support to weaken electrical attraction between the photoconductive support member and image forming particles, and subsequently, the image forming particles on which electrostatic attraction is exerted with respect to the photoconductive support member are distinguished from those free from such electrical attraction, to obtain the resultant image formed by the image forming particles. Since the forming particles according to the present invention are substantially of light transmitting nature, they are free from inconveniences inherent in the conventional photoconductive particles such as residual of electrical charge therein when exposed to light and thus formed images little affected by fogging are obtained. Furthermore, since the image forming particles of the invention are provided with electrical conductivity, the electrical charge of the photoconductive support member is readily attenuated, with the electrostatic attraction between the particles and photoconductive support member being reduced to a negligible amount, still more definite formed images are available.

Meanwhile, for obtaining formed images of still higher quality, it is desirable that the image forming particles be arranged on the photoconductive support member in one single layer without overlapping and yet as close to each other as possible. In connection with the above, if the image forming particles are provided with electrical conductivity, individual image forming particles are electrically independent, with no electrical attraction being exerted between said particles, while such particles are free from mutual adhesion, since they adhere to the photoconductive support member through electrostatic induction of the charge imparted to the latter. In other words, the image forming particles can thus be evenly arranged in one layer and yet be as close to each other as possible on the photoconductive support member for presenting formed images of still higher quality. Accordingly, the electrical conductivity of the image forming particles according to the present invention results in formation of a state wherein said particles are free from being charged and likely to be subjected to electrostatic induction.

Meanwhile, if subliming substances are contained in the image forming particles, images can be readily obtained at will through heating either on the photoconductive support member or on a transfer material such as copy paper or the like. Furthermore, the image forming particles of the present invention can readily be provided with a color separating function by addition thereto of a commercially available dyestuff, and when a subliming dyestuff which is capable of color superposition in a molecular state is employed as the subliming substance, it is possible to obtain color images superior in color reproducibility.

More specifically, examples of materials which can be employed for the image forming particles of the invention are as follows.

As electrically conductive materials to impart the electrical conductivity to the surface and vicinity thereof of the image forming particles, there are various metals, metallic compounds such as titanium oxide, zinc oxide, indium oxide, tin oxide, copper rhodanate, copper iodide, silver bromide, silver iodide, silver iodide rubidium, copper sulfide cadmium sulfide, etc., polyelectrolytes such as polymethyl sodium acrylate, polystyrene sodium sulfonic acid, polyvinyl sodum sulfonic acid, polyvinyl sodium pyrophosphate, polyethyleneimine chloride, poly-N-methyl-4-vinyl pyridinium chloride, poly 2-methacrylo-oxyethlytrimethylammonium chloride, poly 4-vinyl benzyltrimethylammonium chloride, poly 2-acryloxyethyl dimethylsulfonium chloride, polyglycidyl tributyl sulfonium chloride, polvinyl alcohol, polyethylene oxide, polyacrylamide, polyvinyl pyrrolidone, etc., polyelectrolyte double salts in which inorganic electrolytes, for example, sodium bromide, potassium chloride, lithium chloride, etc., are added to the double salt of polystyrene sodium sulfonic acid and polyvinyl benzyltrimethylammonium chloride, complex formed by acceptors of 7,7,8,8-tetracyanoquinodimethane, parachloranil, tetracyanoethylene, etc., and donors of various amines, metals or the like, organic semi-conductors such as poly N-vinyl carbazole, anthracene, etc., surface-active agents such as sodium soap, patash soap, higher alcohol sodium sulfate, alkyl sulfonate, naphthalene sodium sulfonic acid formalin condensate, polyethylene glycol stearylamine, alkyl dimethylamine oxide, stearyl dimethyl benzyl ammonium chloride, alkyl dimethyl benzyl ammonium chloride, polyethylene glycol oleate, polyethylene glycol alkylamine ether, polypropylene glycol polyethylene glycol ether, etc., and special surfaceactive agents of fluorine and silicon groups, etc. Similarily, ion exchange resins such as copolymerizate of divinyl benzene and styrene may also be employed. The electrically conductive materials as described above are normally used independently or in a mixed state, but they may be dispersed in bonding agents for use, depending on the necessity. It is preferable that such electrically conductive materials be of light transmitting nature or white, and also that the image formation particles comprising said materials have specific resistance less than $10^{10}$ Ωcm.

For the subliming materials, subliming dyes and subliming developing agents which develop color through reaction with colorless dyes are available, while the subliming dyes may be divided into colored subliming dye in which the dye itself is colored and subliming colorless dye which develops color upon reaction with the developing agent.

The colored subliming dyes include basic dyes of triphenylmethane group such as malachite green (C.I. Basic Green 4), fuchsin (C.I. Basic Red 9), Primo cyanin BX conc (name used in trade for C.I. Basic Blue 5 and manufactured by the Sumitomo Chemical Co., Ltd. of Japan), Aizen malachite green BH (name used in trade and manufactured by the Hodogaya, Victoria blue F4R (name used in trade for C.I. Solvent Blue 2 and C.I. No. 42563B), etc., disperse dyes such as Miketon fast brilliant blue B (name used in trade for C.I. Disperse Blue 3 and manufactured by the Mitsui Toatsu Chemicals, Inc. of Japan), Kayaron fast blue BR (name used in trade for C.I. Disperse Blue 1 and manufactured by Nippon Kayaku, Inc. of Japan), Diaseriton scarlet B (name used in trade for C.I. Disperse Red 1 and manufactured by Mitsubishi Chemical Industries, Ltd. of Japan), Sumikaron yellow 6G (name used in trade for C.I. Disperse yellow 51 and manufactured by the Sumitomo Chemical Co., Ltd. of Japan), Miketon polyester scarlet 3RC (name used in trade for C.I. Disperse Red 56 and manufactured by the Mitsui Toatsu Chemical Co., Ltd. of Japan), etc., and oil-soluble dyes such as Oil yellow #140 (name used in trade for C.I. Solvent yellow 2 and manufactured by the Yamamoto Kagakugosie Co., Ltd. of Japan), Oil brown BB (name used in trade for C.I. Solvent Red 3 and manufactured by the Orient Chemical Co., Ltd. of Japan), Oreozol red BB (name used in the trade for C.I. Solvent Red 24 and manufactured by the Sumitomo Chemical Co., Ltd. of Japan), etc.

Meanwhile, the colorless subliming dyes which become colored upon reaction with an electron acceptor substance include, for example, Michler's ketone, bis(4-dimethyl amino phenyl) methoxy ethane, N-bis(4-dimethyl phenyl)methyl-N-ethylaniline, N-bis(4-dimethyl phenyl)methyl-(4-hydroxy ethyl) aniline, 2-(4'-hydroxy)styryl-3,3-dimethyl-3H-indole, 2-(2',4'-methoxy anilino-vinylene)-3,3-dimethyl-3H-indole, 2,7-di-(dimethyl amino)-phenazine, 2-amino-7-dimethyl phenazine, 3-dialkyl amino-benzofluorane, 2-(omega-substituted vinylene)-3, 3-2 substituted-3H-indole, 4,4'-dimethylaminodiphenyl ethylene, 1,4,5,8-tetra-amino anthraquinone, carboxy, amino, alkyl, alkoxy or nitro-substituted triphenyl derivative, 1-methylamino-4-ethanolamino anthraquinone, etc.

The developing agents employed for developing colors through reaction with the above described subliming colorless dyes include, for example, fatty acids such as oxalic acid, tartaric acid, trichloracetic acid, citric acid, malic acid, fumaric acid, citraconic acid, suberic acid, maleic acid, behenic acid, etc., and acids of cyclic structure such as ascorbic acid, phenylacetic acid, salicylic acid, gallic acid, picric acid and the like. Apart from the organic acids as described above, inorganic acids such as acid clay, phenol substance such as bis phenol A (4,4'-isopropylidene phenol) and acid polymers such as polyparaphenylphenol may be used.

Furthermore, it is possible to reverse the combination of the subliming colorless dye and developing agent. Namely, subliming developing agents may be used as subliming substances, while colorless dyes which develop color through reaction with said subliming developing agents may be employed. More specifically, in the subliming developing agents, 5-bromosalicyclic acid, 5-chlorosalicyclic acid, acetylsalicyclic acid, etc., are included, while in the colorless dyes, crystal violet lactone, benzoyl leuco methylene blue, rhodamine B lactam, etc., are available.

For obtaining color images, it is necessary to impart color separating function to the image forming particles, for example, by coloring materials which permit transmission of at least one color selected from three primary colors of additive color process. Such coloring materials are employed in combination with the earlier mentioned subliming dye which develops at least one color selected from corresponding three primary colors of subtractive color process. The coloring materials which may be employed according to the invention may be ordinary coloring dyes such as direct dye, acid dye, basic dye, mordant dye, metal complex salt, vat dye, sulfur dye, naphthol dye, oil soluble dye, reactive dye, etc. More specifically, for red color transmitting dyes, C.I (Color Index Code) acid red 6, C.I. acid red 14, C.I. acid red 18, C.I. acid red 27, C.I. acid red 42, C.I. acid red 82, C.I. acid red 133, C.I. acid red 211, C.I. basic red 14, C.I. basic red 27, C.I. basic red 34, etc. are available. As green color transmitting dyes, C.I. acid green 9, C.I. acid green 27, C.I. acid green 40, C.I. acid green 43, C.I. basic green 1, C.I. basic green 4, etc. may be employed, while for blue color transmitting dyes, C.I. acid blue 23, C.I. acid blue 40, C.I. acid blue 62, C.I. acid blue 113, C.I. acid blue 183, C.I. direct blue 86, basic blue 7, C.I. basic blue 22 C.I. basic blue 65, etc. are available. Additionally, it is possible to mix more than two kinds of dyes for the purpose. For example, the blue color transmitting characteristic may be obtained by mixing C.I. acid violet 49 with C.I. acid blue 1, the red color transmitting characteristics by mixing C.I. acid red 94 with C.I. acid yellow 19, and the green color transmitting characteristics by mixing C.I. acid blue 1 with C.I. acid yellow 19. The intended color image can be obtained by mixing the above coloring material and three kinds of image forming particles each containing the subliming dye which develops at least one color selected from three primary colors of subtractive color process.

When the subliming dyes of the above described type are employed, the colored image can be readily obtained as desired either on the photoconductive support member, or on an image receiving medium, while color images having favorable color reproducibility are available since the dyes are capable of color superposition at molecular state.

It should be noted here that the subliming substances such as the subliming dyes and subliming developing agents should preferably be sublimated under normal pressures at temperatures of 80° to 220° C., and that when color images are to be obtained, a plurality of subliming substances employed should preferably sublime at approximately the same temperature. For forming into particles or coating the materials as described above, bonding agents, for example, of natural or synthetic resins superior in translucency may be employed depending on necessity. The natural or synthetic resins employable for the purpose include, for example, styrene resin, acrylate resin, methacrylate ester resin, polyester resin, petroleum resin, nitrocellulose, acetylcellulose, epoxy resin, melamine resin, urea resin, dextrin, polyvinyl alcohol, gelatin, rosin, etc.

Figure 2:
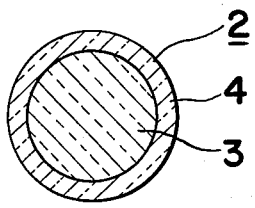
Figure 3:
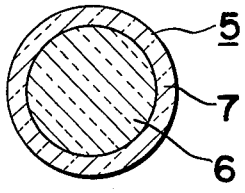

Referring now to FIGS. 1 to 4, there are shown constructions of image forming particles according to the present invention. the particle 1 shown in FIG. 1 has a construction in which the sublimg substance and electrically conductive material are subjected to particle dispersion or molecular dispersion in the light transmitting bonding agent, while the particle 2 illustrated in FIG. 2 has a construction wherein a core 3 formed by particle dispersion or molecular dispersion of the subliming substance in the light transmitting bonding agent is coated by a surface layer 4 containing electrically conductive material. It should be noted here that the positioning of the subliming substance and electrically conductive material may be reversed depending on necessity. Meanwhile, the particle 5 shown in FIG. 3 has such a construction that a core 6 of light transmitting particle such as glass, acrylate resin, styrene resin, melamine resin, etc. is coated by a surface layer 7 containing the subliming material and electrically conductive material. Additionally, the particle 11 of FIG. 4 is so constructed that a core 8 of the light transmitting particle similar to that in FIG. 3 is coated by an intermediate layer 9 containing the subliming substance which is further coated by a surface layer 10 containing the electrically conductive material. It should be noted here that the order for coating the layers 9 and 10 may be reversed depending on requirements, and that the layer 10 containing electrically conductive material preferably has permeability to gas so as not to prevent escape of gases. It should also be noted that, although in the foregoing examples, bonding agents are employed in the portion containing the subliming material or electrically conductive material, such bonding agents may be dispensed with, if the subliming substance or electrically conductive material is provided with bonding capacity of particle forming capacity. Furthermore, the coloring material for imparting the color separating function to the above described particles may be subjected to particle dispersion or molecular dispersion in the light transmitting bonding agent forming the core or in the layers containing the subliming substance and electrically conductive material. Alternatively, a layer containing the coloring material may be formed on the surface of the particles as described above, or glass or resin preliminarily colored may be employed for the purpose.

It is desirable that the particles according to the present invention should preferably be of spherical shape, superior in flow properties and having particle diameter in the region of 1 to 100 microns, preferably 1 to 80 microns. For the manufacturing of the particles according to the present invention, ordinary particle forming methods may be employed such as rolling particle forming method, melt particle forming method, atomization and heating method, flow coating method, stirring particle forming method, surface coating method, etc. for physical processes, and interfacial polymerization, coating by curing in liquid, phase separation from water solutions, phase separation from organic solutions, drying in liquid, fusing dispersion cooling method, capsule enclosure exchange method, powder bed method, etc. for chemical processes. Alternatively, deposition method, plating method and the like may be employed.

Referring now to FIGS. 5 to 13, principle for image formation by employing the image forming particles according to the present invention will be described hereinbelow.

Figure 5:
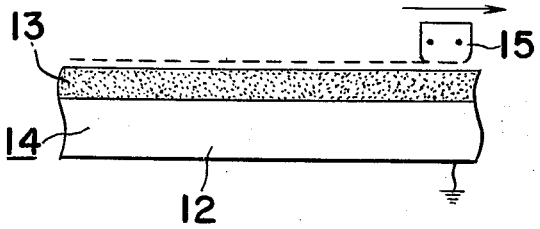

Firstly, as shown in FIG. 5, the photoconductive support member 14 composed of an electrically conductive base 12 on which a photoconductive material layer 13 containing electron accepting material is formed is negatively charged in a dark location by a corona charger unit 15 which is reciprocatingly disposed above and adjacent to the surface of the layer 13. In this case, it is needless to say that the support member 14 is positively charged if the photoconductive material layer 13 is of a P type semiconductor.

Figure 6:
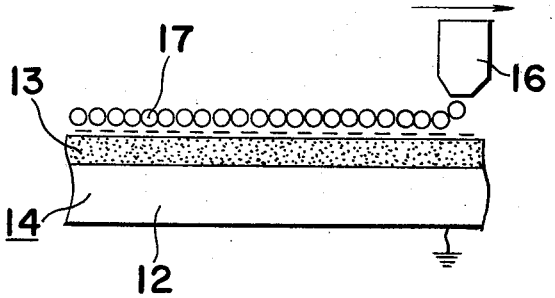

Secondly, as illustrated in FIG. 6, the image forming particles 17 are scattered over the surface of the photoconductive support member 14 imparted with the charge in the above described manner by a particle duster unit 16 which is also reciprocatingly disposed above and adjacent to the surface of the layer 13, with the particles 17 being caused to electrostatically adhere to said surface of the layer 13 through electrostatic induction. In this case, it is preferable that the particles 17 should be arranged approximately in one single layer on said layer 13.

Figure 7:
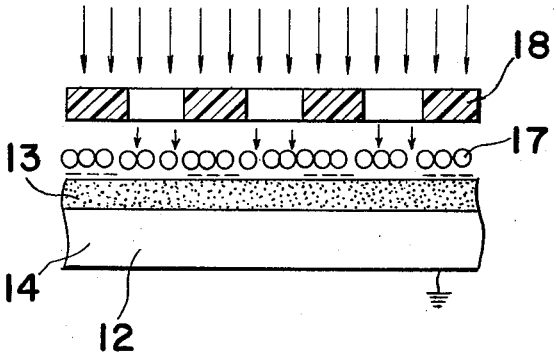
Figure 8:
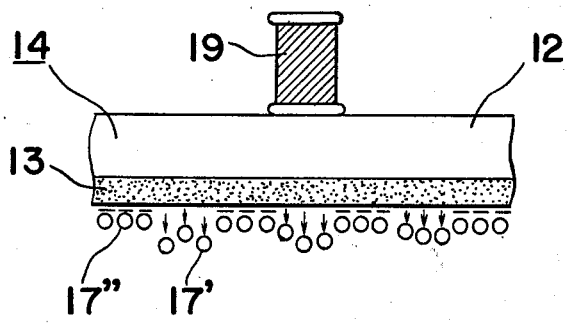

Thirdly, as shown in FIG. 7, the support member 14 bearing thereon the image forming particles 17 arranged in the above described manner is exposed to image-wise light through a light transmitting original 18 to cause the charge of the support member 14 at portions thereof exposed to the light through the particles 17 to be attenuated. In the next step, as illustrated in FIG. 8, the support member 14 thus prepared is turned over, and is caused to vibrate, for example, by an electromagnetic vibrator 19 applied to the reverse surface of the support member 14 for removing particles 17' whose electrostatic attraction is reduced or lost. In the manner as described above, images formed only by remaining particles 17'' which are still subjected to electrostatic attraction are obtained on the support member 14.

Subsequently, when the subliming dye in the particles 17'' is sublimated by heating the particle imges thus formed with a suitable heating means, for example, an infrared ray lamp 20 disposed adjacent to the layer 13 as shown in FIG. 9, color is developed through reaction of the sublimating dye with the electron accepting material in the photoconductive material layer 13. Finally, when the particles 17'' are removed, for example, by a cleaning brush 21 as shown in FIG. 10, developed color images 22 are obtained on the support member 14.

Referring now to FIG. 11, there is shown a modification of the image forming method of FIGS. 5 to 10. In this modification, the photoconductive support member 14 bearing thereon the particle image obtained by the procedure from FIG. 5 to FIG. 8 is brought into close contact under pressure with an image receiving medium 23 coated, for example, with activated or acid clay by pressure rolls 24 rotatably provided adjacent to the support member 14 and heated up to a temperature between 100° and 250° C. for obtaining developed color image 22 on the image receiving medium 23. Subsequently, when the particles 17'' adhering onto the image receiving medium 23 are removed by a cleaning brush (not shown) similar to that described with reference to FIG. 10, a printed image is obtained on said image receiving medium 23. It should be noted here that in the above case, the support member 14 need not necessarily contain the developing agent, and that if a photoconductive support member without the developing agent contained therein is employed, such a support member can be repeatedly used.

In the formation of color images, it is necessary to prepare at least three kinds of light transmitting electrically conductive particles 26, i.e., particles R transmitting red light to develop cyan, particles G transmitting green light to develop magenta and particles B transmitting blue light to develop yellow as shown in FIG. 12. In FIG. 12, corresponding to a color original 25 including red R, green G, blue B, and white W, the charge imparted on the support member 14 is subjected to attenuation in response to the light transmitted through the red, green and blue particles R, G and B of the particles 26. Upon developing in the manner as described with reference to FIG. 8, particle image is obtained as shown in FIG. 13. When the particle image is heated to subject the subliming dyes in the particles 26 to subliming transfer onto the image receiving medium 23, the portion equivalent, for example, to the red R of the color original 25, is reproduced on the image receiving medium 23 as red through mixing of magenta and yellow by the magenta subliming dye in the green G particles and the yellow subliming dye in the blue B particles.

The description with reference to several specific examples of the present invention is given hereinbelow. It should be noted that the scope of the invention is by no means limited to the exact details of the examples described.

EXAMPLE 1

5 g of malachite green and 20 mg of fluorine group surface active agent Megafacks F-142 (name used in trade for $C_8F_{17}SO_2NRCH_2(CH_2CH_2O)_{10}H$, wherein R=alkyl, and manufactured by the Dainippon Ink and Chemicals, Inc. of Japan) were dissolved in 200 g of a 10% by weight aqueous solution of polyvinyl alcohol, and the resulting solution was then supplied into an atomization and heating mill where it was formed into particles which were classified by a standard sieve to obtain image forming particles having diameters in the range from 20 to 25 microns. The particles thus formed were spherical and had specific resistance of $2.8\times10^8\ \Omega$ cm.

Subsequently, the photoconductive support member was prepared as follows. 150 g of zinc oxide in the form of SAZEX #4000 (name used in trade and manufactured by the Sakai Kagaku Kogyo, Inc. of Japan) and 6 g of activated or acid clay were added to 100 g of a 30% toluene solution of a styrene-butadiene copolymer for subsequent thorough mixing thereof in a ball mill through dispersion. The resulting solution was then applied in a layer of 10 to 30 micron thick onto a sheet of aluminized paper to obtain the photoconductive support member.

The photoconductive support member was negatively charged in a dark location by a corona charger unit impressed with voltage of −6 to −7 kv, and the image forming particles described earlier were applied onto the surface of the support member, with subsequent brushing off of the excessive particles not holdable thereon by electrostatic attraction so as to leave an approximately single layer of the particles on the surface of the support member. Thereafter, the particles were exposed for 5 seconds to image-wise light directed throug a black and white transparent original document illuminated by an incandescent lamp, and the photo-attenuated particles were caused to fall off the support member by vibration of the support member, thus a positive image defined by non-irradiated particles remaining in adhesion to the support member being produced. Subsequently, the support member was heated to approximately 180° C. by an infrared lamp, and the remaining particles were brushed off the support member by a hair brush, thus the resultant image developed green in color.

EXAMPLE 2

The following substances were added to 100 g of a 10% by weight aqueous solution of polyvinyl alcohol, and subjected to reaction for 20 minutes at 85° C., while being stirred at high speed, thus particles containing the subliming substances being obtained.

Substances

Butylmethacrylate monomer: 20 g a.a'-Azobisisobutytonitrile: 0.6 g 5-bromosalicyclic acid: 2 g 10 g of the particles thus obtained was mixed with 10 g of a 10% by weight aqueous solution of ECR-34 (name used in trade for polyvinyl ammonium chloride and manufactured by Dow Chemical Company of America), and the resulting solution was then introduced into an atomization and heating mill to be formed into particles which were classified by a standard sieve to obtain image forming particles having diameters in the range from 20 to 25 microns.

Subsequently, the photoconductive support member was prepared as follows. 100 g of zinc oxide in the form of SAZEX #4000 (name used in trade and manufactured by the Sakai Kagaku Kogyo, Inc. of Japan) and 4 g of crystal violet lactone, which is a colorless dye developing color upon reaction with electron accepting substances, were added to 100 g of a 20% by weight toluene solution of an acrylate ester resin, and the resultant solution was subjected to thorough dispersion mixing in a ball mill, and was then applied in a layer of 10 to 30 microns onto a sheet of aluminized paper to obtained the photoconductive support member, on which the image was then formed in the similar manner as described with reference to Example 1. As a result, a clear and defined blue image was obtained. The specific resistance of the image forming particles employed was $8\times10^6\Omega$ cm.

EXAMPLE 3

After forming a thin layer of copper by electroless plating on each of the subliming substances containing particles obtained in Example 2, the resultant particles were introduced into vapor of iodine to form copper iodide on the surfaces of the particles, which were then classified by a standard sieve to obtain image forming particles having diameters in the range from 20 to 25 microns, with specific resistance of $5\times10^5\Omega$ cm. Upon subsequent formation of the image in the similar manner as in Example 2, a definite blue image without fogging was obtained.

EXAMPLE 4

100 g of glass beads having diameters of approximately 20 microns were coated by the flow coating method in an aqueous solution prepared by adding 2.5 g of subliming colorless dye 2-(4'-hydroxy)styryl-3,3-dimethyl-3H-indole, which develops magenta color through reaction with electron accepting substances to 300 g of a 5% by weight aqueous solution of polyvinyl alcohol, thus image forming particles with specific resistance of $6\times10^9\Omega$ cm being obtained. Subsequently, particle image was formed in the similar manner as in Example 1 on a support member of zinc oxide photosensitive paper obtained by a conventional method and made to be panchromatic through dye sensitization. The particle image thus formed was brought into close contact with an image receiving medium prepared by applying a 3% by weight acetone solution of tartaric acid onto paper of high quality, so as to be thereafter heated up to approximately 200° C. by a nichrome wire heater, with subsequent off of the image receiving medium. The particles remaining on the image receiving medium were then removed by a hair brush, and thus a definite image of magenta color was obtained.

EXAMPLE 5

0.5 g of ammonium bicarbonate was further added to the composition of Example 4 an expanding agent to form light transmitting particles in the similar manner as in Example 4. The surfaces of the resultant particles had permeability to gases. Upon formation of an image with said particles in the same manner as in Example 4, a definite image of magenta color still higher in color density was obtained.

EXAMPLE 6

7.2 g of Rese Bengal (C.I. Acid Red 94) and 12.6 g of Sminol levelling yellow NR (named used in trade for C.I. Acid yellow 19 and manufactured by the Sumitono Chemical Co., Ltd. of Japan) were added to 200 g of a 40% by weight aqueous solution of Smitex resin M-3 (name used in trade and including melamine resin manufactured by the Sumitomo Chemical Co., Ltd. of Japan) for subsequent thorough mixing to form a solution A. Meanwhile, 3.6 g of Patent Pure blue-VX (name used in trade for C.I. Acid Blue 1 and manufactured by the Sumitomo Mikuni Chemical Co., Ltd. of Japan) and 19.1 g of Suminol levelling yellow NR were added to a 40% by weight aqueous solution of Smitex resin M-3, with subsequent thorough stirring to form a solution B. Furthermore, 23.2 g of Acid Violet 6B (C.I. Acid Violet 49) and 16.8 g of Patent pure blue-VX were added to 200 g of Sumitex resin M-3 for subsequent thorough stirring to form a solution C.

The three solutions A, B and C as described above were then subjected to the atomization and heating to form particles colored red, green and blue, respectively. Subsequently, 50 g of particles were taken from each of the red, green and blue particles. The 50 g of red particles, together with 2.0 g of subliming colorless dye 4,4-dimethyl amino diphenylethylene, which develops cyan color upon reaction with electron accepting substances, were added to 50 g of a 10% toluene solution of styrene resin, with subsequent thorough stirring to form a solution D. Meanwhile, the 50 g of green particles, together with 1.8 g of subliming colorless dye 2-(4'-hydroxy)styryl-3,3-dimethyl-3H-indole, which develops magenta color upon reaction with electron receiving substances, were added to 50 g of a 10% by weight toluene solution of styrene resin for thorough stirring to form a solution E, while the 50 g of blue particles, together with 4.3 g of the subliming colorless dye Michler's Ketone, which develops yellow color upon reaction with electron accepting substances, were added to 50 g of a 10% by weight of toluene solution of styrene resin, with subsequent thorough stirring to form a solution F.

Each of the D, E and F solutions as described above was subjected to the atomization and heating to coat the surface of each of the particles with a layer containing the subliming colorless dye. Subsequently, 30 g of particles were taken from each of the resultant particles from the D, E and F solutions to be mixed with each other, and then added to 100 g of a 10% by weight water solution of ECR-34 with subsequent thorough stirring. The resultant solution was again subjected to the atomization and heating to be formed into particles which were classified by a standard sieve to obtain image forming particles having diameters of 20 to 25 microns and coated with layers containing electrically conductive material. The particles thus obtained had approximately spherical shape, with specific resistance of $5\times10^{6}\Omega$ cm.

Subsequently, a photoconductive support member prepared by a zinc oxide sensitive paper produced by a conventional method and made to be panchromatic through dye sensitization was negatively charged in a dark location by a corona charger unit to which voltage between $-6$ and $-7$ kv was impressed. In the next step, the image forming particles prepared by mixing the above three kinds were scattered on the surface of the above described support member, with subsequent brushing off of excessive particles not affected by electrostatic attraction. As a result, an approximately single layer of particles was obtained on the surface of the support member. Thereafter, the particles were exposed to image-wise light directed through a color transparent original document illuminated by an incandescent lamp so as to be developed by the device explained with reference to FIG. 8 the obtaining the particle image. The particle image thus obtained was then brought into close contact with an image receiving medium applied with the acid clay to be heated to approximately 200° C. by a nichrome heater. The image receiving medium subsequently peeled off was brushed off by a hair brush to remove the particles remaining thereon, and thus a definite color image faithful to the color original document was obtained.

As is clear from the foregoing description, the image forming particles according to the present invention are most suitable for the process for obtaining color images superior in color reproducibility through only one exposure stage and only one development stage. More specifically, the superior translucency of the particles of the invention advantageously reduces the fogging, while the electrical conductivity of said particles facilitates erasing the charge of the photoconductive support member, with consequent reduction of electrostatic attraction between the particles and the photoconductive support member to zero, thus resultant images having less fogging being obtainable. Moreover, for obtaining images of still higher quality, it is preferable that the particles are arranged on the photoconductive support member in one layer without overlapping each other and yet as close to each other as possible. In this respect, the image forming particles of the invention are very advantageous, since they are electrically independent due to their electrical conductivity without any electrostatic attraction acting between the particles. Furthermore, since the particles of the invention adhere to the photoconductive support member by electrostatic induction of the charge imparted to the support member, no adhesion takes place between the particles, thus making it possible to uniformly arrange the particles on the support member in one layer and as close to each other as possible, and consequently, to obtain resultant images of high quality. Additionally, in the particles of the invention containing the subliming substances, the desired images can be readily formed at will through heating either on the support member or on the image receiving medium. It is another advantage of the image forming particles of the present invention that these particles are easy to manufacture and are readily imparted with color separating functions by commercially available dyes and present clear and definite color images superior in color reproducibility by the use of subliming dyes as subliming substances for the formation of color images, since such subliming dyes make it possible to effect color superposition in the molecular state.

Although the present invention has been fully described by way of example with reference to the attached drawings, it is to be noted that various changes and modifications are apparent to those skilled in the art. Therefore, unless otherwise such changes and modification depart from the scope of the present invention, they should be construed as included therein.

What is claimed is:

1. Image forming particles for use in an electrostatic image formation process which comprises the steps of:

(1) providing a photoconductive support member and said image forming particles;

(2) imparting to said photoconductive support an electrostatic charge, whereby said image forming particles are caused to adhere to the surface of said photocondutive support by electrostatic induction;

(3) exposing the charged photoconductive support member of (2) having said particles adhered thereto by electrostatic force, to a light image, the charge of the photoconductive support member at portions thereof being exposed to the light through the particles being attenuated, whereby the image of said particles is formed on said support by utilizing the difference in electrostatic attraction between the photoconductive support member and said image forming particles, said image on said support corresponding to said light image;

(4) heating the particles on the photoconductive support member obtained by the step (3) to cause a sublimable substance contained in said particles to be sublimed, whereby the colored image is obtained by causing said sublimable substance to adhere to said photoconductive support member or image receptor containing therein developing color agent which forms the colored image through reaction with said sublimable substance;

said particles comprising a sublimable substance selected from the group consisting of a colored subliming dye, a subliming colorless dye which is colorless in its normal state and develops color upon reaction with developing agent and a subliming developing agent which is colorless in its normal state and develops color upon reaction with a colorless dye and an electrically conductive substance which facilitates the electrostatic induction of said particles, and said particles being capable of transmitting light and having a specific resistance of less than $10^{10}$ ohm cm.

2. Image forming particles as claimed in claim 1, wherein said electrically conductive material is dispersed in each of said particles.

3. Image forming particles as claimed in claim 1, wherein said electrically conductive material is formed into an electrically conductive layer provided on surface of each of said particles.

4. Image forming particles as claimed in claim 3, wherein said electrically conductive layer has sufficient permeability to gases to permit escape of said sublimable substance from said particles when heated.

5. Image forming particles as claimed in claim 1 wherein said subliming substance is uniformly dispersed in each of the particles.

6. Image forming particles as claimed in claim 1, wherein said particles comprise a layer containing said sublimable substance and a layer containg said electrically conductive material.

7. Image forming particles as claimed in claim 1, wherein said particles comprise a core material of light transmitting property coated by a first layer containing said sublimable substance, said first layer being further coated by a second layer containing said electrically conductive material.

8. Image forming particles as claimed in claim 7, wherein said second layer containing said electrically conductive material has permeability to gases.

9. Image forming particles as claimed in claim 1, wherein said sublimable substance has a subliming temperature in the range from 80° to 220° C.

10. Image forming particles as claimed in claim 1, wherein said sublimable substance is sublimable dye.

11. Image forming particles as claimed in claim 10, wherein said sublimable dye is subliming colorless dye which is colorless in the normal state and develops color upon reaction with a developing agent.

12. Image forming particles as claimed in claim 1, wherein said sublimable substance is sublimable developing agent which develops color upon reaction with colorless dye.

13. Image forming particles as claimed in claim 1, wherein said particles exhibit selective spectral light transmission.

14. Image forming particles as claimed in claim 13, wherein said selective spectral light transmitting property of said particles is capable of transmitting one color selected from three primary colors of the additive color process.

15. Image forming particles as claimed in claim 13, wherein said sublimable substance is capable of developing one color selected from three primary colors of the subtractive color process.

16. Image forming particles as claimed in claim 1, wherein said electrically conductive contained in said particles for imparting electrically conductive property thereto is capable of light transmission.

17. Image forming particles as claimed in claim 1, wherein the each of said particles has an approximately spherical shape.

18. Image forming particles as claimed in claim 1, wherein said particles have diameters in the range from 1 to 80 microns.

19. An electrostatic image formation process which comprises the steps of:

(1) providing a photoconductive support member and image forming particles;

(2) imparting to said photoconductive support an electrostatic charge, whereby said image forming particles are caused to adhere to the surface of said photoconductive support by electrostatic induction;

(3) exposing the charged photoconductive support member of (2) having said particles adhered thereto by electrostatic force, to a light image, the charge of the photoconductive support member at portions thereof being exposed to the light through the particles being attenuated, whereby the image of said particles is formed on said support by utilizing the difference in electrostatic attraction between the photoconductive support member and said image forming particles, said image on said support corresponding to said light image;

(4) heating the particles on the photoconductive support member obtained by the step (3) to cause a sublimable substance contained in said particles to be sublimed, whereby the colored image is obtained by causing said sublimable substance to adhere to said photoconductive support member or image receptor containing therein developing color agent which forms the colored image through reaction with said sublimable substance;

said particles comprising a sublimable substance selected from the group consisting of a colored subliming dye, a subliming colorless dye which is colorless in its normal state and develops color upon reaction with developing agent and a subliming developing agent which is colorless in its normal state and develops color upon reaction with a colorless dye and an electrically conductive substance which facilitates the electrostatic induction of said particles, and said particles being capable of transmitting light and having a specific resistance of less than $10^{10}$ ohms cm.

* * * * *